US012385335B1

(12) United States Patent
Krishnamoorthy et al.

(10) Patent No.: US 12,385,335 B1
(45) Date of Patent: Aug. 12, 2025

(54) LIFTING ASSEMBLY FOR DUST CURTAIN OF WORK MACHINE

(71) Applicant: Caterpillar Global Mining Equipment LLC, Denison, TX (US)

(72) Inventors: Tamilselvan Krishnamoorthy, Chennai (IN); Scott Alan Christianson, Edelstein, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 18/437,319

(22) Filed: Feb. 9, 2024

(51) Int. Cl.
*E21B 21/015* (2006.01)

(52) U.S. Cl.
CPC ..... *E21B 21/015* (2013.01)

(58) Field of Classification Search
CPC ..... E21B 21/015; E21B 21/011; B28D 7/02; E01C 2301/50
See application file for complete search history.

(56) References Cited

U.S. PATENT DOCUMENTS 1,127,225 A * 2/1915 Galligan ..... E21B 21/015 175/209
1,128,674 A * 2/1915 Galligan ..... E21B 21/015 277/634
1,131,052 A * 3/1915 Galligan ..... E21B 21/015 175/209
2,596,670 A * 5/1952 Clinton ..... B23Q 11/0046 175/209
3,616,477 A * 11/1971 Larson ..... E01H 1/056 15/82
3,800,890 A * 4/1974 Gyongyosi ..... E21B 21/015 175/209
5,894,096 A * 4/1999 Kotraba ..... G01N 1/04 15/257.6
2007/0094819 A1* 5/2007 Lougheed ..... E01H 1/045 15/84
2011/0037307 A1* 2/2011 Bollinger ..... B28D 1/045 299/41.1
2015/0176345 A1* 6/2015 Koskinen ..... E21B 19/24 175/57

(Continued)

FOREIGN PATENT DOCUMENTS

CN 204060773 12/2014
CN 204060774 12/2014
CN 209308656 8/2019

(Continued)

*Primary Examiner* — Kipp C Wallace

(57) ABSTRACT

A lifting assembly for a dust curtain of a work machine includes a pair of mounting brackets. Each mounting bracket is coupled to a frame of the work machine. The lifting assembly also includes an arm assembly pivotally coupled to each mounting bracket and is movable relative to the mounting brackets between a first state in which the dust curtain is disposed in a lowered position and a second state in which the dust curtain is disposed in a lifted position. The arm assembly includes a first arm member and a second arm member. The first arm member includes a first linear portion and a first curved portion. The second arm member includes a second linear portion and a second curved portion. The lifting assembly further includes a lifting plate coupled to the dust curtain and a linkage assembly coupling the arm assembly with the lifting plate.

20 Claims, 5 Drawing Sheets

(56) References Cited

U.S. PATENT DOCUMENTS

| | | | | |
|---|---|---|---|---|
| 2017/0226808 | A1* | 8/2017 | Vandapel | E21B 12/06 |
| 2020/0102711 | A1* | 4/2020 | Vetrucci | A47L 11/24 |

FOREIGN PATENT DOCUMENTS

| | | |
|---|---|---|
| CN | 209637805 | 11/2019 |
| KR | 102217729 | 2/2021 |
| KR | 102354430 | 1/2022 |
| KR | 20230102210 | 7/2023 |

* cited by examiner

LIFTING ASSEMBLY FOR DUST CURTAIN OF WORK MACHINE

TECHNICAL FIELD

The present disclosure relates to a work machine, and more particularly to, a lifting assembly for a dust curtain of the work machine.

BACKGROUND

A work machine, such as a rotary drilling machine, includes a component for example, a hammer, a drill pipe, and the like to perform one or more drilling operations. In an example, the drilling operation may include drilling of a hole. The work machine includes a curtain assembly that encloses a work area around the hole to prevent scattering of material that is being removed from the hole. Typically, the curtain assembly includes a number of dust curtains that enclose a pile of material, such as, a sand pile around the hole or to enclose the hole itself.

Currently, the work machine includes a lifting assembly for lifting a rear dust curtain of the curtain assembly during a forward movement of the work machine. During a reverse movement of the work machine, it may be required to lift a front dust curtain of the curtain assembly to prevent contact of the front dust curtain with the material pile. An absence of the lifting assembly for the front dust curtain may reduce productivity at a worksite due to falling of material back in the hole, which is not desirable. However, the lifting assembly for the rear dust curtain may not be usable to lift the front dust curtain. This happens because the front dust curtain has no ground clearance and the lifting assembly may get damaged as it is mounted on a mast and is movable. Damage to the lifting assembly may increase operational cost of the work machine.

Further, a position of the front dust curtain relative to a fuel tank of the work machine and an axle of the work machine is such that conventional curtain lifting assemblies may interfere with the fuel tank and the axle while moving the front dust curtain between lowered and lifted positions. Therefore, an improved lifting assembly for the front dust curtain is desired.

CN209308656U describes a drilling dust blocking device of a rotary drill. The baffle is used for preventing dust in the drill hole from diffusing. The rotary drill is provided with a platform. The drilling dust blocking device comprises a dust blocking plate, a first dust blocking curtain and a driving mechanism. Wherein one end of the dust blocking plate is hinged to the platform, the other end of the dust blocking plate is connected with the first dust blocking curtain, the dust blocking plate and the first dust blocking curtain can prevent dust in the drilled hole from diffusing outwards, and the driving mechanism can drive the dust blocking plate to rotate relative to the platform so that the first dust blocking curtain can be away from or make contact with the ground. By the adoption of the drilling dust blocking device of the rotary drill, the dust blocking curtain can be prevented from being abraded by the ground, it is guaranteed that an operator accurately locates the drilling position, and mechanical parts are convenient to maintain.

SUMMARY OF THE DISCLOSURE

In an aspect of the present disclosure, a lifting assembly for a dust curtain of a work machine is provided. The lifting assembly includes a pair of mounting brackets. Each mounting bracket defines a first end and a second end distal from the first end. Each mounting bracket is adapted to be coupled to a frame of the work machine at the first end. The lifting assembly also includes an arm assembly pivotally coupled to each mounting bracket at the second end of a corresponding mounting bracket. The arm assembly is movable relative to the mounting brackets between a first state in which the dust curtain is disposed in a lowered position and a second state in which the dust curtain is disposed in a lifted position. The arm assembly defines a third end and a fourth end distal from the third end. The arm assembly includes a first arm member coupled to one of the pair of mounting brackets. The first arm member includes a first linear portion and a first curved portion extending from the first linear portion. The arm assembly also includes a second arm member coupled to another of the pair of mounting brackets. The second arm member includes a second linear portion and a second curved portion extending from the second linear portion. The lifting assembly further includes a lifting plate coupled to the dust curtain. The lifting assembly includes a linkage assembly coupling the arm assembly with the lifting plate. The linkage assembly is coupled to the arm assembly at the fourth end of the arm assembly.

In another aspect of the present disclosure, a work machine is provided. The work machine includes a frame. The work machine also includes a curtain assembly coupled to the frame and adapted to enclose a work area. The curtain assembly includes a dust curtain disposed proximal to a first end of the work machine. The work machine further includes a lifting assembly for the dust curtain. The lifting assembly includes a pair of mounting brackets. Each mounting bracket defines a first end and a second end distal from the first end. Each mounting bracket is coupled to the frame of the work machine at the first end. The lifting assembly also includes an arm assembly pivotally coupled to each mounting bracket at the second end of a corresponding mounting bracket. The arm assembly is movable relative to the mounting brackets between a first state in which the dust curtain is disposed in a lowered position and a second state in which the dust curtain is disposed in a lifted position. The arm assembly defines a third end and a fourth end distal from the third end. The arm assembly includes a first arm member coupled to one of the pair of mounting brackets. The first arm member includes a first linear portion and a first curved portion extending from the first linear portion. The arm assembly also includes a second arm member coupled to another of the pair of mounting brackets. The second arm member includes a second linear portion and a second curved portion extending from the second linear portion. The lifting assembly further includes a lifting plate coupled to the dust curtain. The lifting assembly includes a linkage assembly coupling the arm assembly with the lifting plate. The linkage assembly is coupled to the arm assembly at the fourth end of the arm assembly.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
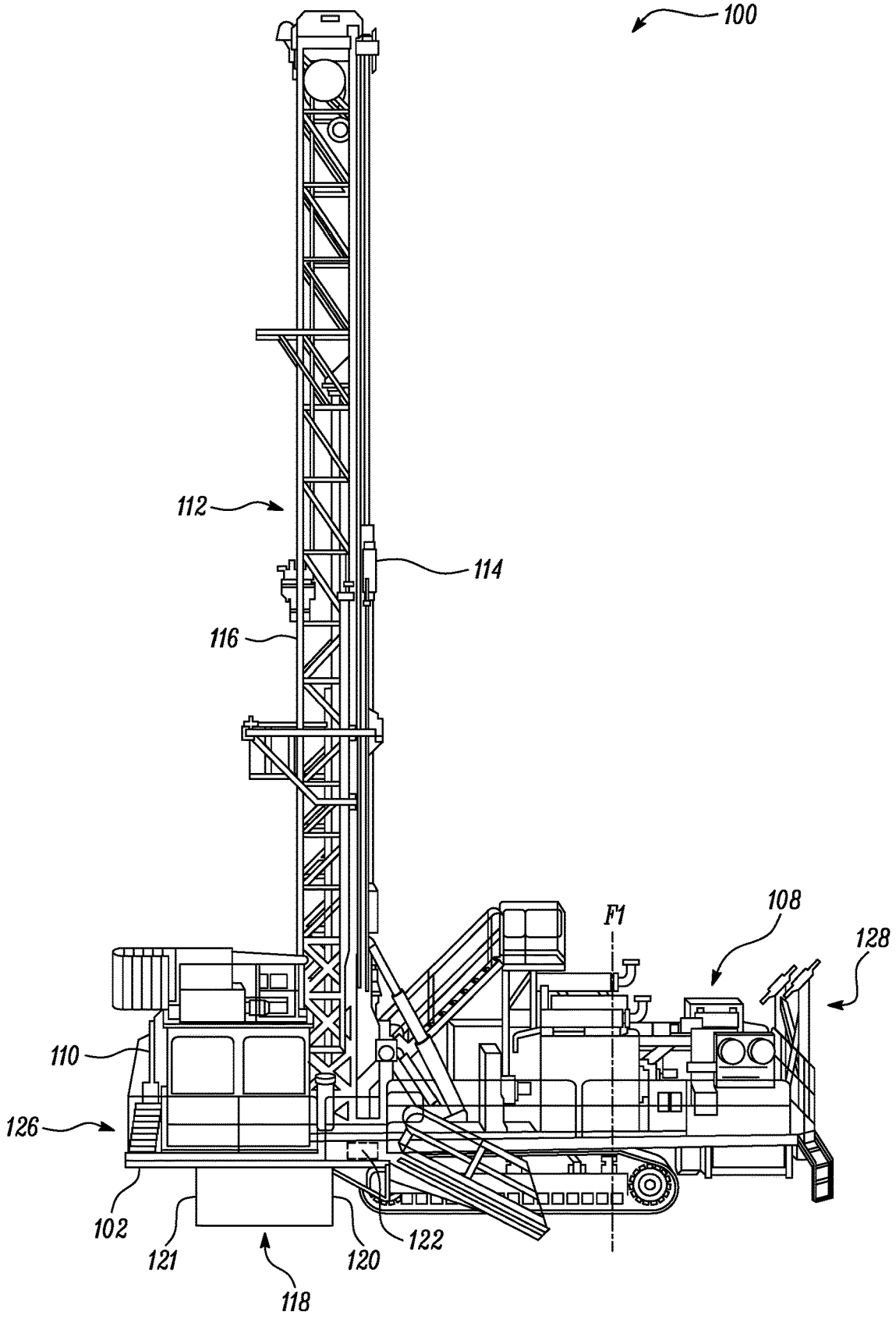
FIG. 1 is a schematic side view of an exemplary work machine.

Referring to FIG. 1, a schematic side view of an exemplary work machine 100 is illustrated. The work machine 100 may be used to perform one or more drilling operations, such as, drilling holes, mining blast holes or geothermal wells, and the like. The work machine 100 may include a rotary work machine or a down-the-hole work machine. In the illustrated example of FIG. 1, the work machine 100 is embodied as the rotary work machine. The work machine 100 defines a first axis "F1". The first axis "F1" extends generally in a vertical direction.

As shown in FIG. 1, the work machine 100 includes a frame 102. The frame 102 may be supported on a ground surface by a transport mechanism, such as, crawler tracks 104. The crawler tracks 104 may allow the work machine 100 to maneuver on the ground surface to a desired location for a drilling operation. Alternatively, the work machine 100 may include wheels instead of the crawler tracks 104. The frame 102 includes one or more jacks (not shown herein) for supporting and leveling the work machine 100 on the ground surface during the drilling operation. In an example, the one or more jacks may lift the work machine 100 above the ground surface along the first axis "F1" during the drilling operation. The work machine 100 also includes a machinery 108. The frame 102 may support the machinery 108, which may include various components (not shown), such as, a power source (for example, an engine, a battery system, and/or a fuel system), motors, batteries, pumps, air compressors, and/or any other equipment necessary to supply power to operate the work machine 100. The frame 102 further supports an operator cabin 110, from which an operator may maneuver and control the work machine 100.

The work machine 100 includes a mast assembly 112. The mast assembly 112 may be supported by the frame 102 of the work machine 100. The mast assembly 112 extends along the first axis "F1". The work machine 100 includes a drill head 114 movable relative to the mast assembly 112. The drill head 114 is movable along the first axis "F1". The drill head 114 may be supported on a mast frame 116. The machinery 108 may provide power to operate the drill head 114 relative to the mast assembly 112. In some examples, the work machine 100 may include one or more motors associated with the drill head 114. The work machine 100 also includes a drill pipe or a hammer coupled to the drill head 114 to perform the drilling operation. The work machine 100 further includes a fuel tank 122. In some examples, the fuel tank 122 may store liquid fuel such as diesel, petrol, and the like. In other examples, the fuel tank 122 may store gaseous fluid, such as, compressed natural gas, liquified petroleum gas, and the like.

Figure 2:
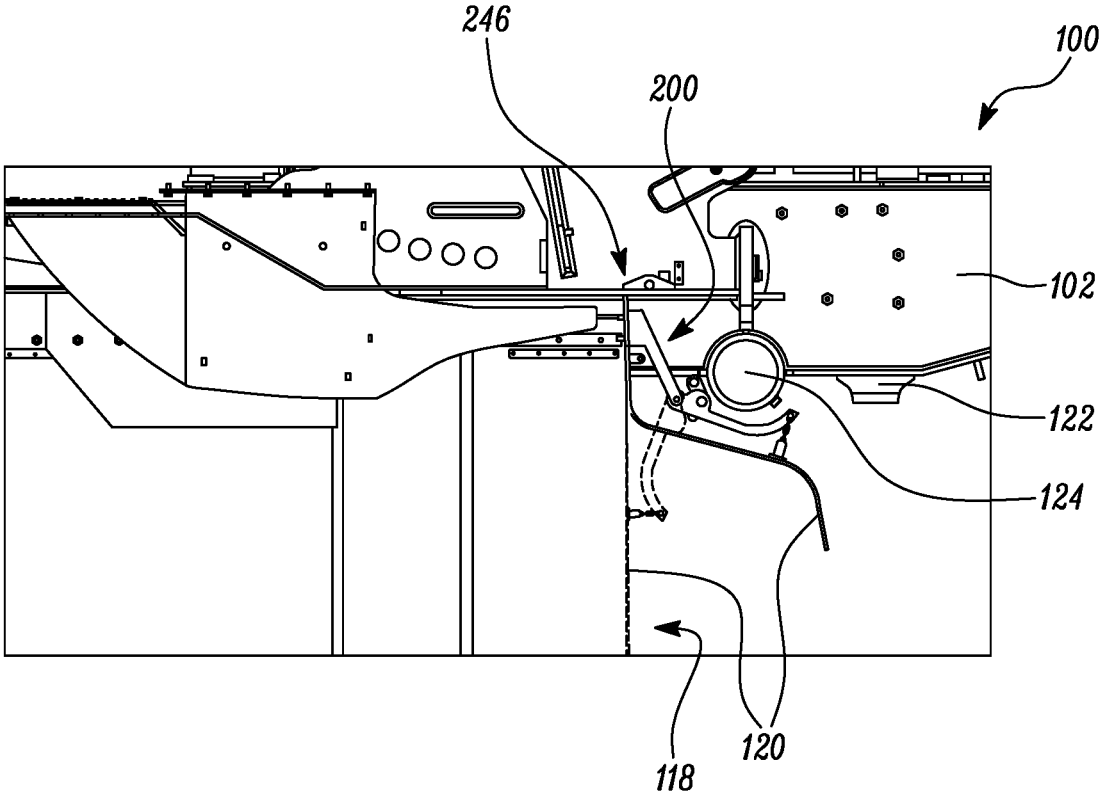
FIG. 2 is a schematic side view illustrating a lifting assembly for a dust curtain of the work machine of FIG. 1.

Referring to FIG. 2, the work machine 100 includes an axle 124. The axle 124 includes a front axle of the work machine 100 to support the crawler tracks 104 proximal to a first end 126 (see FIG. 1) of the work machine 100. Further, the work machine 100 also includes a rear axle (not shown herein) to support the crawler tracks 104 proximal to a second end 128 (see FIG. 1) of the work machine 100.

The work machine 100 also includes a curtain assembly 118 coupled to the frame 102 and adapted to enclose a work area. The curtain assembly 118 may form a closed box enclosing the work area such that the curtain assembly 118 prevents material, such as sand that is being removed/drilled out from a hole, to be blown out in the surrounding. Thus, the curtain assembly 118 may prevent diffusion of material that may otherwise cause visual line obstruction of operators and environmental pollution. The curtain assembly 118 includes a dust curtain 120 disposed proximal to the second end 128 of the work machine 100. Particularly, the dust curtain 120 is a front dust curtain 120 disposed proximal to the second end 128 of the work machine 100. The dust curtain 120 will be hereinafter interchangeably referred to as "front dust curtain 120". The front dust curtain 120 is disposed proximal to the axle 124 of the work machine 100. The curtain assembly 118 also includes a rear dust curtain 121 (see FIG. 1) disposed proximal to the first end 126 of the work machine 100. In some examples, the dust curtains 120, 121 may be made of rubber material, without any limitations.

The work machine 100 includes a lifting assembly 200 for the dust curtain 120. The lifting assembly 200 moves the front dust curtain 120 between a lowered position and a lifted position. In the illustrated embodiment of FIG. 2, the work machine 100 includes the lifting assembly 200 for the front dust curtain 120. The lifting assembly 200 is movable by an angle of 90 degrees in an anti-clockwise direction to move the front dust curtain 120 from the lowered position to the lifted position. Moreover, the lifting assembly 200 is movable by an angle of 90 degrees in a clockwise direction to move the front dust curtain 120 from the lifted position to the lowered position.

Figure 3:
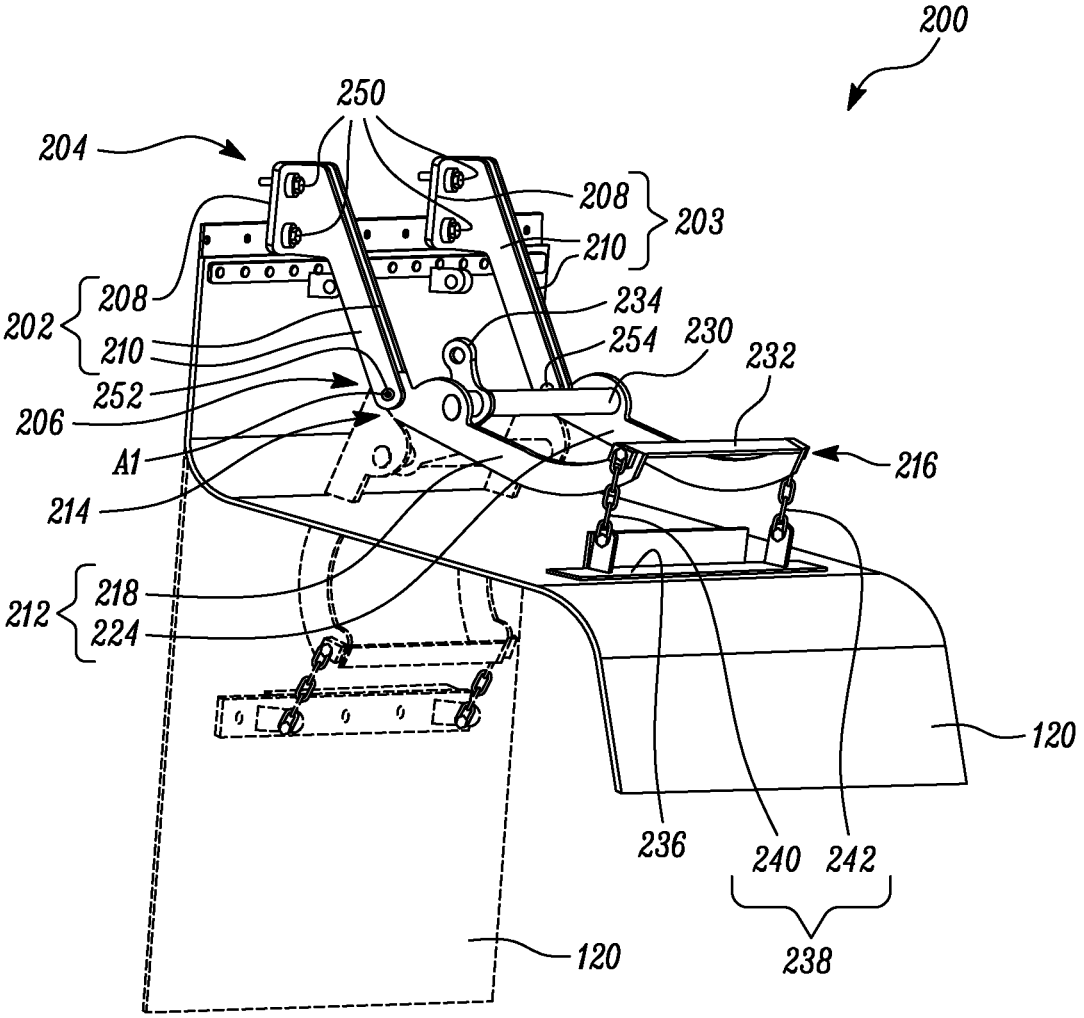
FIG. 3 is a schematic perspective view of the lifting assembly of FIG. 2.

Referring to FIG. 3, a schematic perspective view of the lifting assembly 200 for the front dust curtain 120 of the work machine 100 of FIG. 1 is illustrated. When in the lowered position, the lifting assembly 200 may be disposed at a distance from between 180 millimeters (mm) to 300 mm from the ground surface. When in the lifted position, the lifting assembly 200 may be disposed at a distance from between 450 mm to 600 mm from the ground surface.

The lifting assembly 200 includes a pair of mounting brackets 202, 203. Each mounting bracket 202, 203 defines a first end 204 and a second end 206 distal from the first end 204. Each mounting bracket 202, 203 is coupled to the frame 102 (see FIG. 2) of the work machine 100 at the first end 204.

Each of the pair of mounting brackets 202, 203 includes a first mounting plate 208 coupled with the frame 102 of the work machine 100. Specifically, each first mounting plate 208 is coupled with the frame 102 via a pair of mechanical fasteners 250. In some examples, the mechanical fastener 250 may include a bolt, a screw, a rivet, and the like. Further, each of the pair of mounting brackets 202, 203 includes a pair of second mounting plates 210 extending from the first mounting plate 208. The pair of second mounting plates 210 are coupled with an arm assembly 212.

The lifting assembly 200 also includes the arm assembly 212 pivotally coupled to each mounting bracket 202, 203 at the second end 206 of a corresponding mounting bracket 202, 203. Specifically, the arm assembly 212 is pivotally coupled to the second mounting plates 210 of the mounting brackets 203. The arm assembly 212 is movable relative to the mounting brackets 202, 203 between a first state in which the dust curtain 120 is disposed in the lowered position (shown with dotted lines) and a second state (shown with solid lines) in which the dust curtain 120 is disposed in the lifted position. The arm assembly 212 defines a third end 214 and a fourth end 216 distal from the third end 214.

The arm assembly 212 includes a first arm member 218 coupled to one of the pair of mounting brackets 202. The arm assembly 212 also includes a second arm member 224 coupled to another of the pair of mounting brackets 203. Specifically, each of the first arm member 218 and the second arm member 224 is pivotally coupled with a corresponding second mounting plate 210 of the mounting bracket 202, 203 at a pivot point A1. The first arm member 218 is coupled to the second mounting plate 210 of the mounting bracket 202, via a mechanical fastener 252. Further, the second arm member 224 is coupled to the second mounting plate 210 of the mounting bracket 203, via a mechanical fastener 254.

Figure 4:
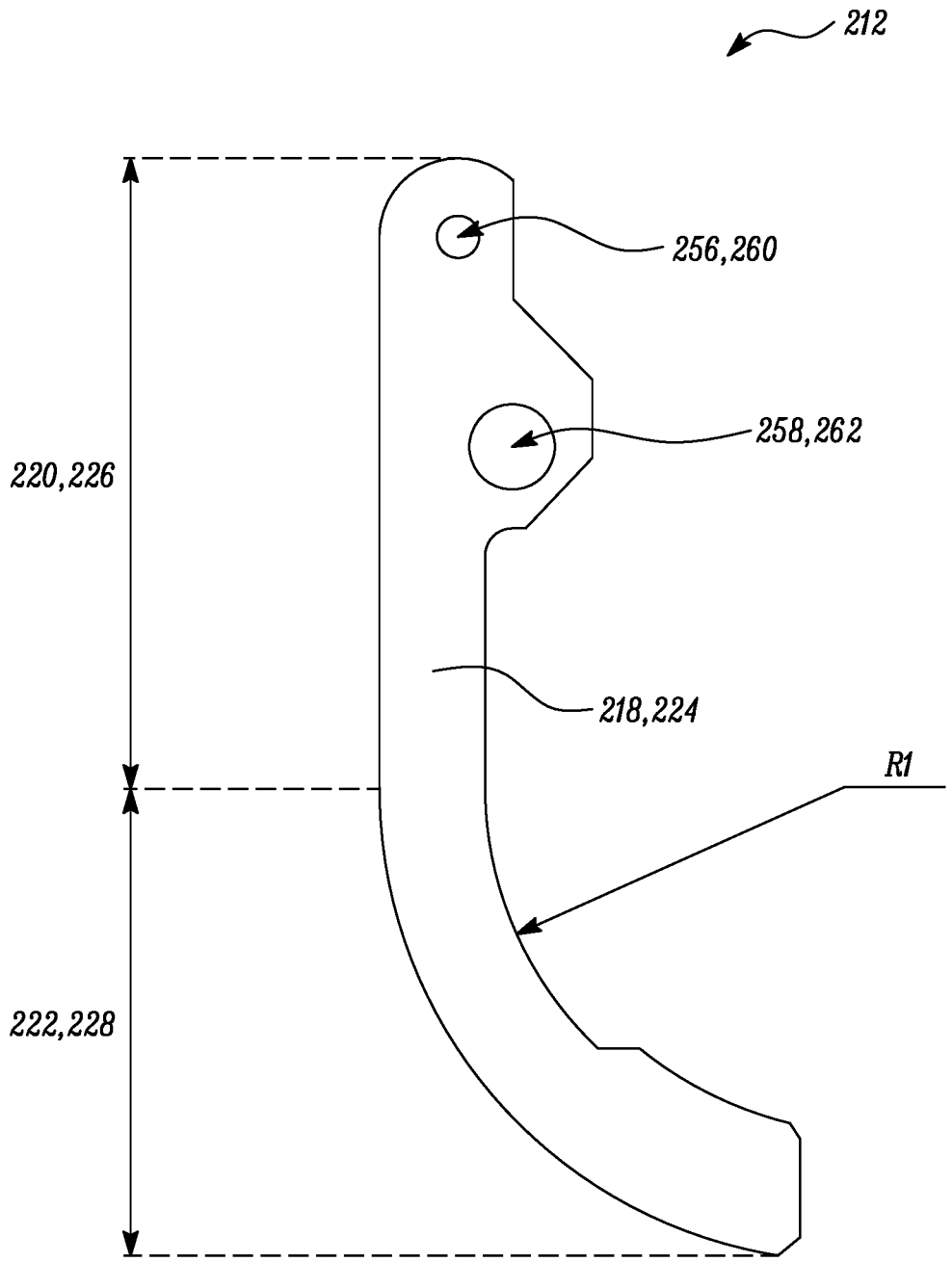
FIG. 4 is a schematic side view of a portion of an arm assembly of the lifting assembly of FIG. 2.

Referring now to FIG. 4, a schematic side view of the arm assembly 212 is illustrated. The first arm member 218 and the second arm member 224 are similar to each other in terms of design and dimensions. The first arm member 218 includes a first linear portion 220 and a first curved portion 222 extending from the first linear portion 220. The first arm member 218 includes a first opening 256 to receive the mechanical fastener 252 (see FIG. 3) and a second opening 258 to receive a portion of a third arm member 230 (see FIG. 3). The second arm member 224 includes a second linear portion 226 and a second curved portion 228 extending from the second linear portion 226. The second arm member 224 includes a third opening 260 to receive the mechanical fastener 254 (see FIG. 3) and a second opening 262 to receive a portion of the third arm member 230. Each of the first curved portion 222 of the first arm member 218 and the second curved portion 228 of the second arm member 224 defines a radius of curvature "R1" that lies between 100 mm and 160 mm. In one specific example, the radius of curvature "R1" may be approximately equal to 130 mm.

Referring again to FIG. 3, the arm assembly 212 further includes the third arm member 230 extending between the first arm member 218 and the second arm member 224. The third arm member 230 is disposed proximal to the third end 214 of the arm assembly 212. The third arm member 230 connects the first arm member 218 and the second arm member 224 proximal to the third end 214 of the arm assembly 212. In an example, the third arm member 230 may be coupled to the first arm member 218 and the second arm member 224 via mechanical fasteners or any joining techniques, such as, welding, soldering, brazing, and the like. The arm assembly 212 also includes a bracket 234 coupled to the third arm member 230. In an example, the bracket 234 may be coupled to the third arm member 230 via any joining techniques, such as, welding, soldering, brazing, and the like.

The arm assembly 212 includes a fourth arm member 232 extending between the first arm member 218 and the second arm member 224. The fourth arm member 232 is disposed proximal to the fourth end 216 of the arm assembly 212. The fourth arm member 232 connects the first arm member 218 and the second arm member 224 proximal to the fourth end 216 of the arm assembly 212. In an example, the fourth arm member 232 may be coupled to the first arm member 218 and the second arm member 224 via mechanical fasteners or any joining techniques, such as, welding, soldering, brazing, and the like.

Figure 5:
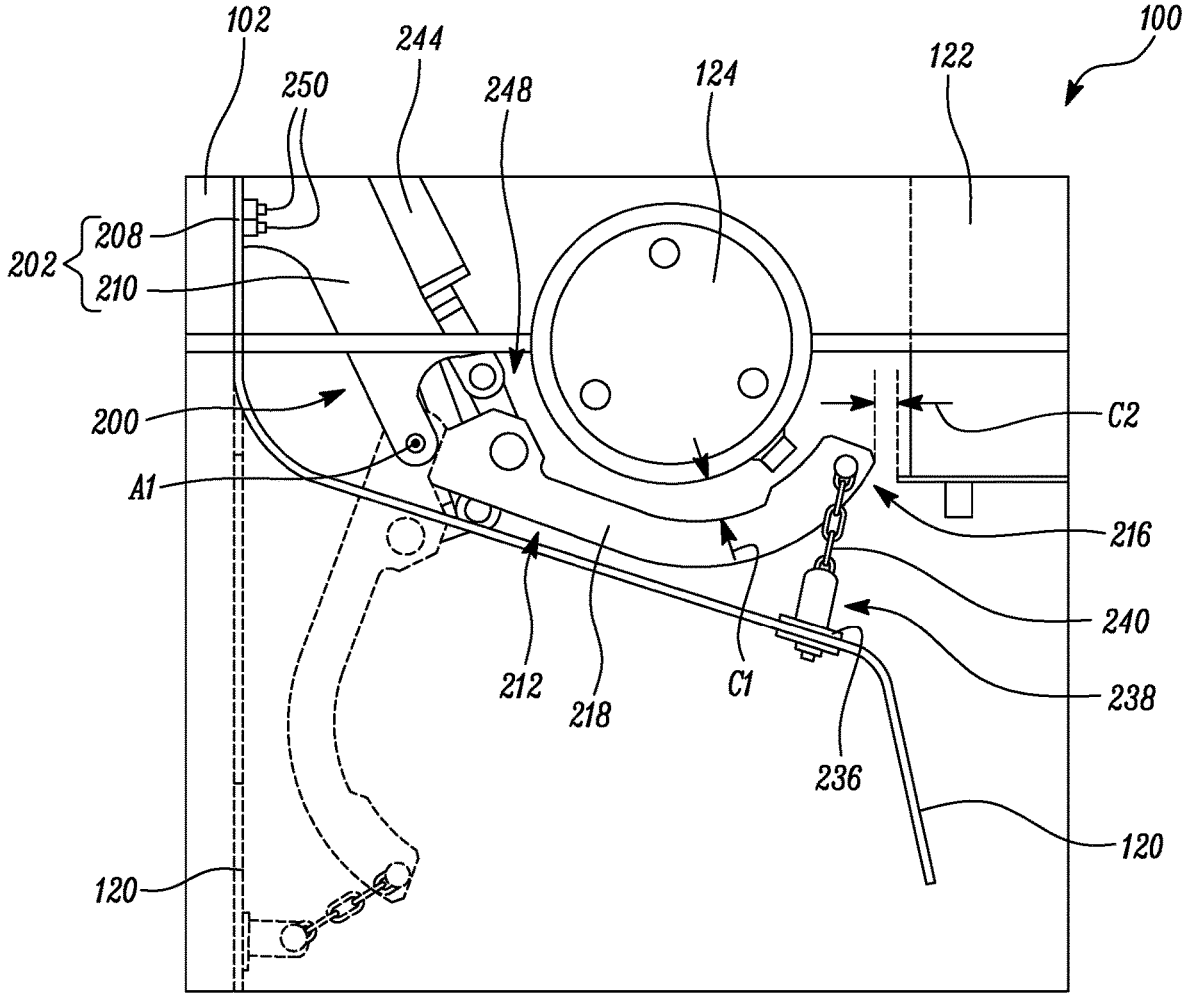
FIG. 5 is a schematic side view illustrating a positioning of the lifting assembly of FIG. 2 relative to an axle and a fuel tank of the work machine.

With reference to FIGS. 3 and 5, the lifting assembly 200 further includes a lifting plate 236 coupled to the dust curtain 120. In some examples, the lifting plate 236 may be coupled to the dust curtain 120 via mechanical fasteners, adhesives, or any joining techniques, such as, welding, soldering, brazing, and the like, without any limitations.

The lifting assembly 200 includes a linkage assembly 238 coupling the arm assembly 212 with the lifting plate 236. The linkage assembly 238 is coupled to the arm assembly 212 at the fourth end 216 of the arm assembly 212. The linkage assembly 238 includes a first linkage element 240 extending between the first arm member 218 and the lifting plate 236 and a second linkage element 242 extending between the second arm member 224 and the lifting plate 236. Each of the first linkage element 240 and the second linkage element 242 includes a chain link. Specifically, the first linkage element 240 is coupled with the first arm member 218 and the second linkage element 242 is coupled with the second arm member 224. In an example, the first linkage element 240 may be coupled with the first arm member 218 via mechanical fasteners or using joining techniques, such as, welding, brazing, soldering, and the like. In an example, the second linkage element 242 may be coupled with the second arm member 224 via mechanical fasteners or using joining techniques, such as, welding, brazing, soldering, and the like.

Referring to FIG. 5, the lifting assembly 200 also includes an actuator 244 coupled to the frame 102 of the work machine 100 at one end 246 (see FIG. 2) and the bracket 234 of the arm assembly 212 at another end 248. The actuator 244 allows the arm assembly 212 to move between the first state and the second state. In some examples, the actuator 244 may include a hydraulic actuator, a pneumatic actuator, an electric actuator, and the like. In some cases, the actuator 244 may be communicably coupled with an electronic control unit (not shown) of the work machine 100, such that the operator may be able to control the actuator 244 from the operator cabin 110 (see FIG. 1) to move the arm assembly 212 between the first state and the second state.

When the arm assembly 212 is in the second state (shown with solid lines), each of the first arm member 218 and the second arm member 224 (see FIG. 3) of the arm assembly 212 are radially spaced apart from the axle 124. More particularly, when the arm assembly 212 is in the second state, the first and second arm members 218, 224 may be radially spaced apart from the axle 124 by a radial clearance "C1" that may lie between 30 mm and 65 mm, for example.

Further, when the arm assembly 212 is in the second state, the fourth end 216 of the arm assembly 212 is axially spaced apart from the fuel tank 122 of the work machine 100. More particularly, when the arm assembly 212 is in the second state, the first and second arm members 218, 224 may be axially spaced apart from the fuel tank 122 by an axial clearance "C2" that may lie between 30 mm to 70 mm, for example.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the lifting assembly 200 for the front dust curtain 120 of the work machine 100. The lifting assembly 200 is usable to lift the front dust curtain 120 during a reverse movement of the work machine 100 in order to prevent a contact of the front dust curtain 120 with a pile of material removed from a drilled hole. The positioning of the front dust curtain 120 in the lifted position may prevent falling of material, such as, sand back into the drilled hole. The lifting assembly 200 is disposed at sufficient clearance from the ground surface in each of the lowered position and the lifted position, which may prevent damage to the lifting assembly 200, thereby reducing costs associated with installing a replacement lifting assembly.

The lifting assembly 200 includes the arm assembly 212 having the first arm member 218 and the second arm member 224. The first arm member 218 includes the first curved portion 222 and the second arm member 224 includes the second curved portion 228, such that in the second state of the arm assembly 212, the first curved portion 222 and the second curved portion 228 are radially spaced apart from the axle 124. In other words, the first curved portion 222 and the second curved portion 228 prevents interference of the lifting assembly 200 with the axle 124. Each of the first curved portion 222 and the second curved portion 228 of the arm assembly 212 is designed to utilize a space around the axle 124 to lift the dust curtain 120 up to a maximum height without interfering with the axle 124.

Further, the fourth end 216 of the arm assembly 212 is axially spaced apart from the fuel tank 122 of the work machine 100 and does not engage with the fuel tank 122. The lifting assembly 200 of the present disclosure may improve a productivity of the work machine 100 as the usage of the lifting assembly 200 may prevent contact of the front dust curtain 120 with the material removed from drilled holes. The lifting assembly 200 may be cost-effective as it has a simple design. Moreover, the lifting assembly 200 may be retrofitted on existing work machines.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

What is claimed is:

1. A lifting assembly for a dust curtain of a drilling or mining machine, the lifting assembly including:

a pair of mounting brackets, each mounting bracket defining a first end and a second end distal from the first end, each mounting bracket being coupled to a frame of the drilling or mining machine at the first end;

an arm assembly pivotally coupled to each mounting bracket at the second end of a corresponding mounting bracket, the arm assembly being movable relative to the mounting brackets between a first state in which the dust curtain is disposed in a lowered position and a second state in which the dust curtain is disposed in a lifted position, the arm assembly defining a third end and a fourth end distal from the third end, the arm assembly including:

a first arm member coupled to one of the pair of mounting brackets, the first arm member including a first linear portion and a first curved portion extending from the first linear portion; and a second arm member coupled to another of the pair of mounting brackets, the second arm member including a second linear portion and a second curved portion extending from the second linear portion;

a lifting plate coupled to the dust curtain; and a linkage assembly coupling the arm assembly with the lifting plate, wherein the linkage assembly is coupled to the arm assembly at the fourth end of the arm assembly.

2. The lifting assembly of claim 1, wherein the arm assembly further includes:

a third arm member extending between the first arm member and the second arm member, and disposed proximal to the third end of the arm assembly; and a fourth arm member extending between the first arm member and the second arm member, and disposed proximal to the fourth end of the arm assembly.

3. The lifting assembly of claim 2, wherein the arm assembly further includes a bracket coupled to the third arm member.

4. The lifting assembly of claim 3 further comprising an actuator coupled to the frame of the work machine at one end and the bracket of the arm assembly at another end.

5. The lifting assembly of claim 1, wherein each of the pair of mounting brackets includes:

a first mounting plate adapted to be coupled with the frame of the work machine; and a pair of second mounting plates extending from the first mounting plate, wherein the pair of second mounting plates are coupled with the arm assembly.

6. The lifting assembly of claim 1, wherein the dust curtain is disposed proximal to an axle of the work machine, and wherein, when the arm assembly is in the second state, each of the first arm member and the second arm member of the arm assembly are radially spaced apart from the axle.

7. The lifting assembly of claim 1, wherein, when the arm assembly is in the second state, the fourth end of the arm assembly is axially spaced apart from a fuel tank of the work machine.

8. The lifting assembly of claim 1, wherein each of the first curved portion of the first arm member and the second curved portion of the second arm member defines a radius of curvature that lies between 100 millimeters and 160 millimeters.

9. The lifting assembly of claim 8, wherein the linkage assembly includes a first linkage element extending between the first arm member and the lifting plate and a second linkage element extending between the second arm member and the lifting plate.

10. The lifting assembly of claim 9, wherein each of the first linkage element and the second linkage element includes a chain link.

11. The lifting assembly of claim 1, wherein the dust curtain is a front dust curtain disposed proximal to a first end of the work machine.

12. A work machine comprising:

a frame;

a curtain assembly coupled to the frame and adapted to enclose a work area, the curtain assembly including a dust curtain disposed proximal to a first end of the work machine, wherein the work machine is a drilling or mining machine; and a lifting assembly for the dust curtain, the lifting assembly including:

a pair of mounting brackets, each mounting bracket defining a first end and a second end distal from the first end, each mounting bracket being coupled to the frame of the work machine at the first end;

an arm assembly pivotally coupled to each mounting bracket at the second end of a corresponding mounting bracket, the arm assembly being movable relative to the mounting brackets between a first state in which the dust curtain is disposed in a lowered position and a second state in which the dust curtain is disposed in a lifted position, the arm assembly defining a third end and a fourth end distal from the third end, the arm assembly including:

a first arm member coupled to one of the pair of mounting brackets, the first arm member including a first linear portion and a first curved portion extending from the first linear portion; and a second arm member coupled to another of the pair of mounting brackets, the second arm member including a second linear portion and a second curved portion extending from the second linear portion;

a lifting plate coupled to the dust curtain; and a linkage assembly coupling the arm assembly with the lifting plate, wherein the linkage assembly is coupled to the arm assembly at the fourth end of the arm assembly.

13. The work machine of claim 12, wherein the arm assembly further includes:

a third arm member extending between the first arm member and the second arm member, and disposed proximal to the third end of the arm assembly; and a fourth arm member extending between the first arm member and the second arm member, and disposed proximal to the fourth end of the arm assembly.

14. The work machine of claim 13, wherein the arm assembly further includes a bracket coupled to the third arm member.

15. The work machine of claim 14, wherein the lifting assembly further includes an actuator coupled to the frame of the work machine at one end and the bracket of the arm assembly at another end.

16. The work machine of claim 12, wherein each of the pair of mounting brackets includes:

a first mounting plate adapted to be coupled with the frame of the work machine; and a pair of second mounting plates extending from the first mounting plate, wherein the pair of second mounting plates are coupled with the arm assembly.

17. The work machine of claim 12 further comprising an axle, wherein the dust curtain is disposed proximal to the axle, and wherein, when the arm assembly is in the second state, each of the first arm member and the second arm member of the arm assembly are radially spaced apart from the axle.

18. The work machine of claim 12 further comprising a fuel tank, wherein, when the arm assembly is in the second state, the fourth end of the arm assembly is axially spaced apart from the fuel tank.

19. The work machine of claim 12, wherein each of the first curved portion of the first arm member and the second curved portion of the second arm member defines a radius of curvature that lies between 100 millimeters and 160 millimeters.

20. The work machine of claim 12, wherein the linkage assembly includes a first linkage element extending between the first arm member and the lifting plate and a second linkage element extending between the second arm member and the lifting plate, and wherein each of the first linkage element and the second linkage element includes a chain link.

* * * * *